United States Patent [19]

Dzewaltowski et al.

[11] Patent Number: 4,531,327

[45] Date of Patent: Jul. 30, 1985

[54] CENTERLESS GRINDING MACHINE WITH FERRIS WHEEL ARRANGEMENT

[75] Inventors: Victor F. Dzewaltowski; Lawrence I. Millay, both of Springfield, Vt.

[73] Assignee: Ex-Cell-O Corporation, Troy, Mich.

[21] Appl. No.: 488,239

[22] Filed: Apr. 25, 1983

[51] Int. Cl.[3] ..... B24B 5/32; B24B 5/40

[52] U.S. Cl. ..... 51/103 WH; 51/108 R; 51/215 AR; 51/237 T; 51/290

[58] Field of Search ..... 51/103 R, 103 WH, 104, 51/105 R, 108 R, 215 AR, 215 HM, 216 ND, 237 T, 281 P, 290, 291; 409/143, 221

[56] References Cited

U.S. PATENT DOCUMENTS

| | | | |
|---|---|---|---|
| 1,858,869 | 5/1932 | White | 51/216 ND X |
| 1,974,696 | 9/1934 | Swanson | 51/103 WH X |
| 2,805,524 | 9/1957 | Silven | 51/215 HM X |
| 3,269,064 | 8/1966 | Lockwood | 51/215 HM X |
| 3,553,907 | 1/1971 | Price | 51/103 C |
| 4,052,821 | 10/1977 | McCandless et al. | 51/237 T X |

FOREIGN PATENT DOCUMENTS

| | | | |
|---|---|---|---|
| 2309691 | 9/1973 | Fed. Rep. of Germany | 51/103 WH |
| 766833 | 10/1980 | U.S.S.R. | 51/103 R |

*Primary Examiner*—Robert P. Olszewski

*Attorney, Agent, or Firm*—Edward J. Timmer

[57] ABSTRACT

A centerless grinding machine is provided with a ferris wheel arrangement having multiple, circumferential pockets in which an annular workpiece is received from a loading chute, is internally ground by a grinding wheel and is discharged into an unloading chute after grinding by indexed rotation of the ferris wheel. The grinding machine includes a stationary alignment shoe cooperating with an individual alignment shoe carried in each pocket of the ferris wheel. In the grinding position, the stationary shoe preferably is at the 3 o'clock position while the alignment shoe in the adjacent pocket is at the 6 o'clock position. The grinding wheel is positioned on one side of the ferris wheel and a workpiece driver means is positioned on the opposite side. With the inventive grinding machine, annular workpieces, such as bearing raceways, can be loaded, ground and unloaded in rapid succession with high accuracy maintained during grinding.

7 Claims, 5 Drawing Figures

CENTERLESS GRINDING MACHINE WITH FERRIS WHEEL ARRANGEMENT

FIELD OF THE INVENTION

The present invention relates to grinding machines and, in particular, to centerless grinding machines with a ferris wheel means in which a workpiece is loaded, ground and discharged by rotation of the ferris wheel to indexed positions.

BACKGROUND OF THE INVENTION

Centerless grinding machines are known in the art and are used for grinding the internal surface concentric with the external surface on an annular workpiece such as, for example, a ball bearing ring or raceway.

In automatic grinding machines of this type, it is important that the loading and unloading of workpieces be effected with high accuracy and in short times. Various types of workpiece loading and unloading mechanisms have been developed in the past for centerless grinding machines as illustrated in the following U.S. patents:

U.S. Pat. No. 2,635,395 issued Apr. 21, 1953
U.S. Pat. No. 2,706,369 issued Apr. 19, 1955
U.S. Pat. No. 2,723,499 issued Nov. 15, 1955
U.S. Pat. No. 2,754,641 issued July 17, 1956
U.S. Pat. No. 2,927,406 issued Mar. 8, 1960
U.S. Pat. No. 3,023,552 issued Mar. 6, 1962
U.S. Pat. No. 3,280,512 issued Oct. 25, 1966
U.S. Pat. No. 3,640,026 issued Feb. 8, 1972

The present invention resulted from a desire to provide a significant improvement over presently available centerless grinding machines having automatic workpiece loading, grinding and unloading features.

SUMMARY OF THE INVENTION

The present invention provides an improved centerless grinding machine characterized as having a rotatable ferris wheel means with one or more pocket means in which a workpiece is received, ground and then discharged as the ferris wheel means is rotated to different positions. The grinding machine includes a stationary workpiece alignment shoe which cooperates with a workpiece alignment shoe carried in each pocket of the ferris wheel means.

In a typical working embodiment of the invention, the ferris wheel means includes multiple, peripherally spaced pockets, preferably three pockets spaced 120° apart, with a workpiece alignment shoe being positioned in each pocket such that when a particular pocket is indexed to the grinding position the shoe will be in a 6 o'clock position. The stationary shoe on the machine is preferably disposed at a 3 o'clock position relative to the alignment shoe of the adjacent pocket in the grinding position.

In a preferred working embodiment of the invention, a grinding wheel means is positioned on one side of the ferris wheel means and is movable both axially into the annular workpiece and radially into engagement with the inner workpiece surface. A workpiece driver means, such as a magnetic driver, is located on the other side of the ferris wheel means for rotating the workpiece in the pocket of the ferris wheel means during grinding. An indexing means is provided for indexing the ferris wheel means, in particular the pockets, from a workpiece loading chute where a workpiece is received, to a grinding position where the stationary and movable alignment shoes are in the 3 o'clock and 6 o'clock positions and where the workpiece is internally ground and then to a discharge position where the ground workpiece falls into a discharge chute. In the grinding position, the grinding wheel means is moved radially to engage the inner surface of the annular workpiece and bias the workpiece against the 3 o'clock and 6 o'clock shoes during grinding, thereby assuring that the inner workpiece surface is ground concentric with the outer surface. The ferris wheel arrangement preferably includes a back support plate and a front support plate spaced apart by a sufficient distance to allow the workpiece and ferris wheel carrying the workpiece to fit with clearance between the plates. Loading and unloading chutes are preferably attached to the back support plate. Each support plate has an opening coaxial with the workpiece-receiving pocket of the ferris wheel means when the particular pocket is in the grinding position to allow access of the grinding wheel means to the inside of the workpiece and to allow coupling of the workpiece driver means. A longitudinally tapered, cam actuated locating pin is provided to releasably engage the ferris wheel in the grind position.

The present invention thereby provides a centerless grinding machine adapted for automated operation wherein workpieces are loaded, ground and unloaded in rapid succession and wherein the workpieces at the same time are accurately positioned for precision grinding. Furthermore, the ferris wheel and alignment shoe arrangement is compact in size with few components.

DESCRIPTION OF PREFERRED EMBODIMENTS

Figure 1:
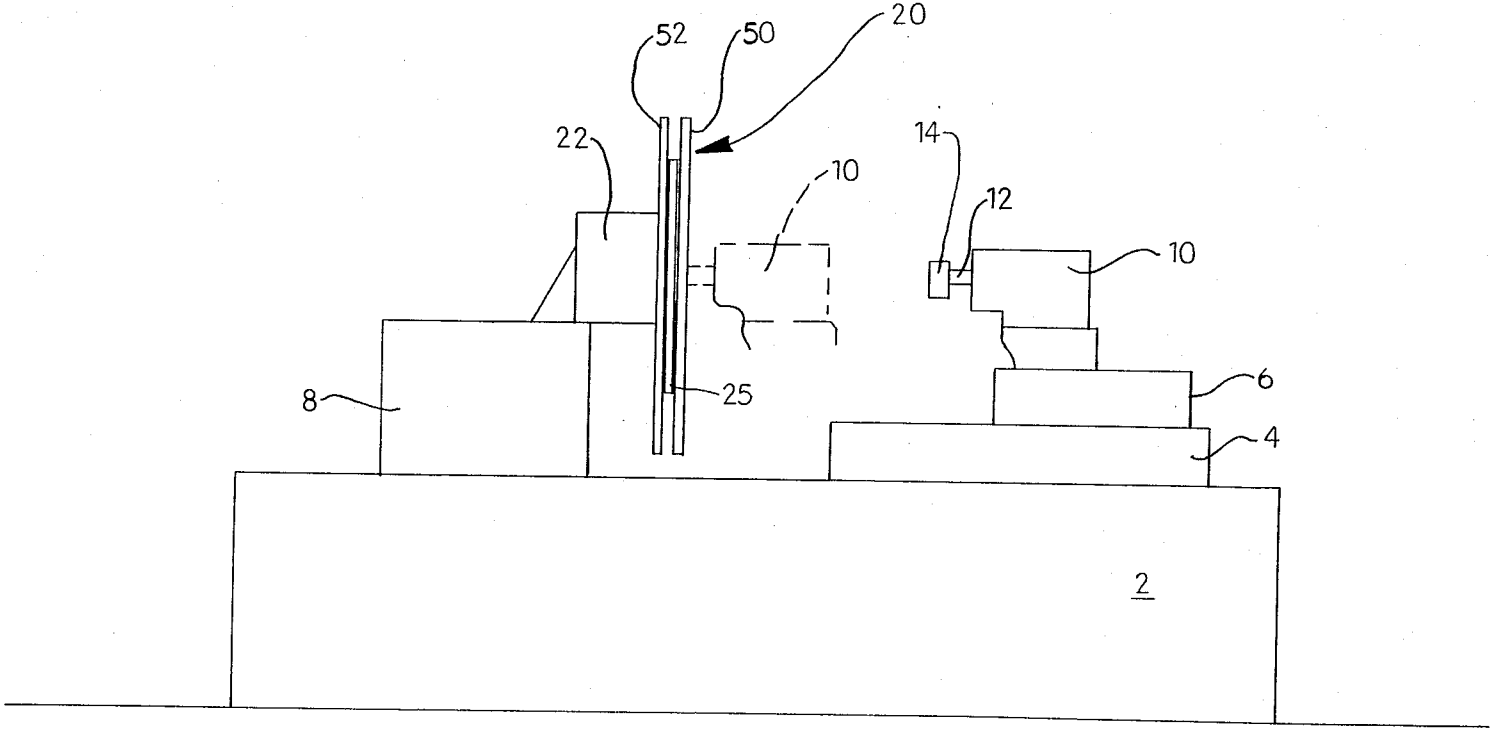
FIG. 1 is a somewhat schematic front elevation of a centerless grinding machine constructed according to the invention.
Figure 2:
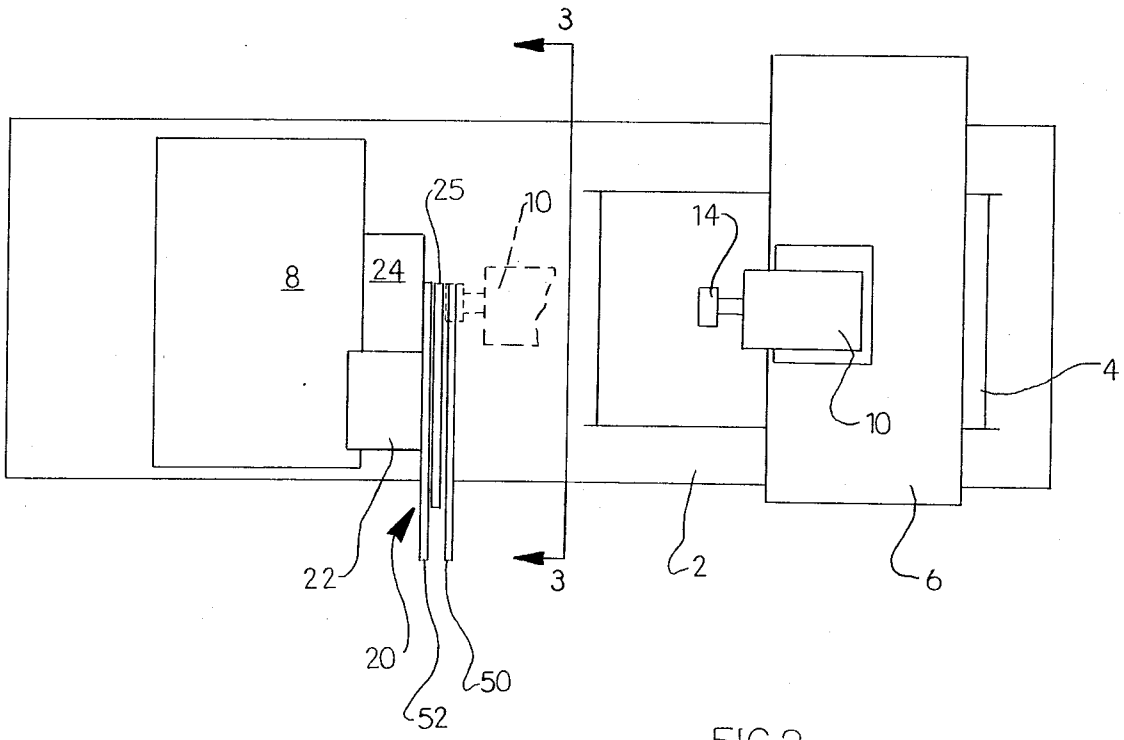
FIG. 2 is a somewhat schematic top plan view of the grinding machine of FIG. 1.
Figure 3:
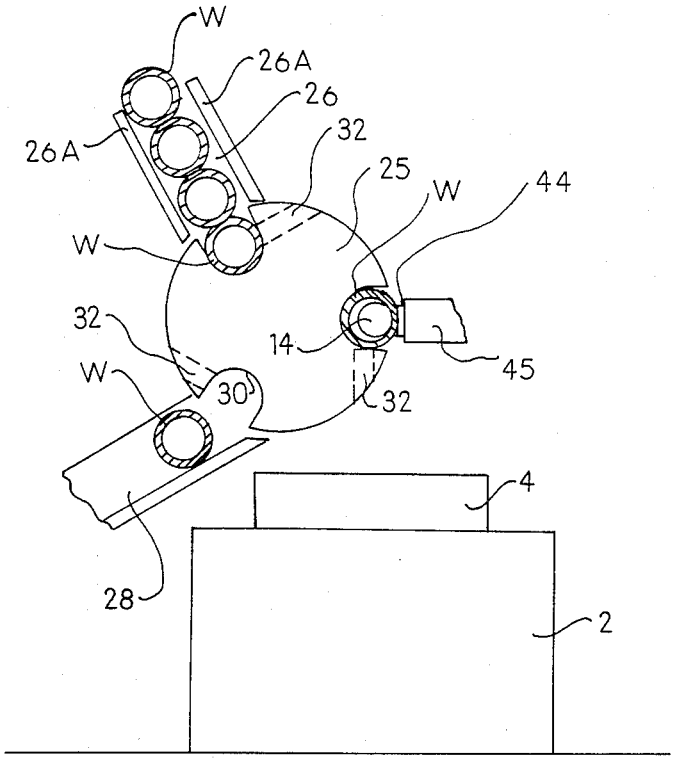
FIG. 3 is a somewhat schematic elevation of the grinding machine taken along line 3—3 of FIG. 2 as viewed in the direction of the arrows.
Figure 4:
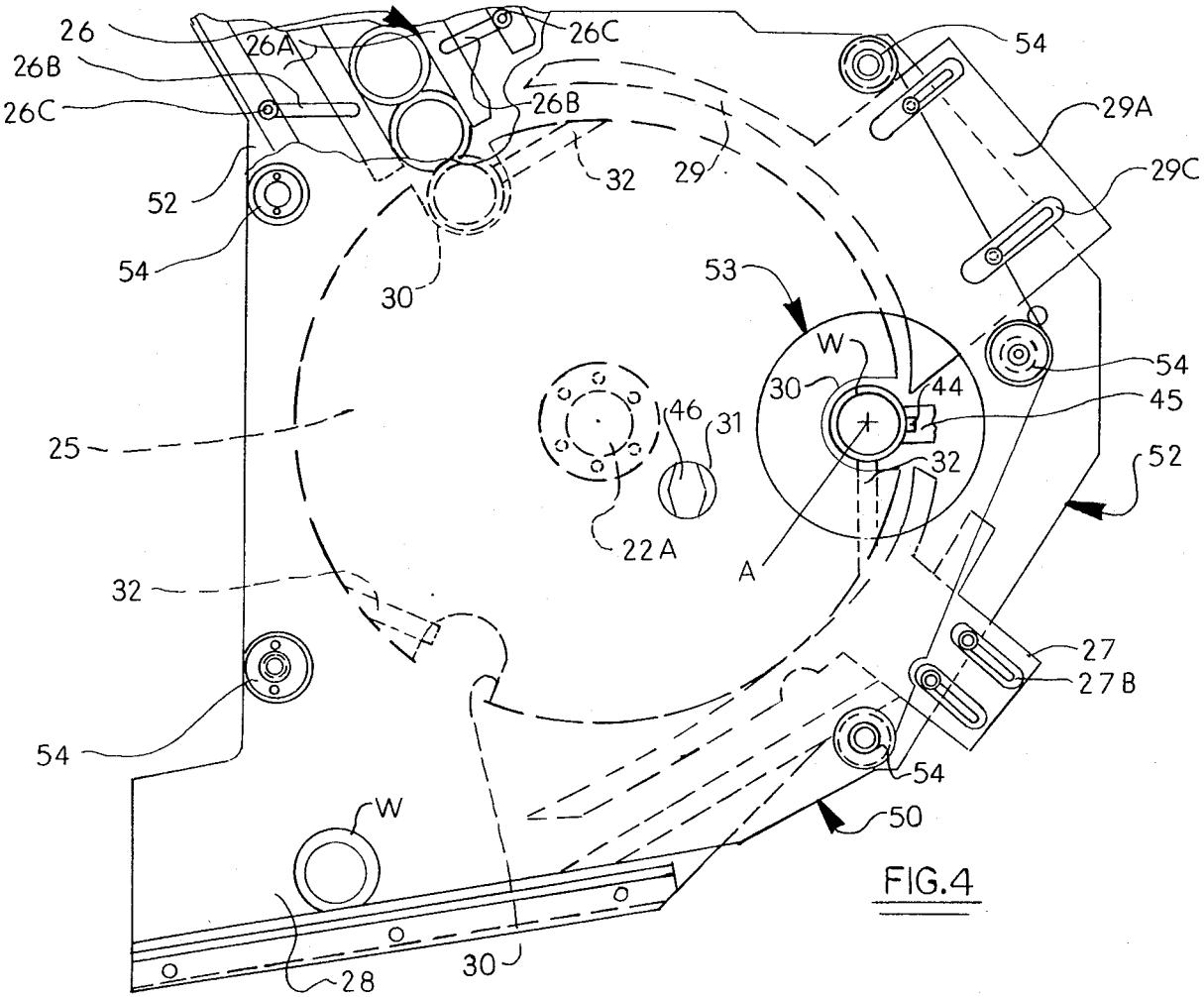
FIG. 4 is a fragmentary side elevation of the ferris wheel arrangement similar to FIG. 3.
Figure 5:
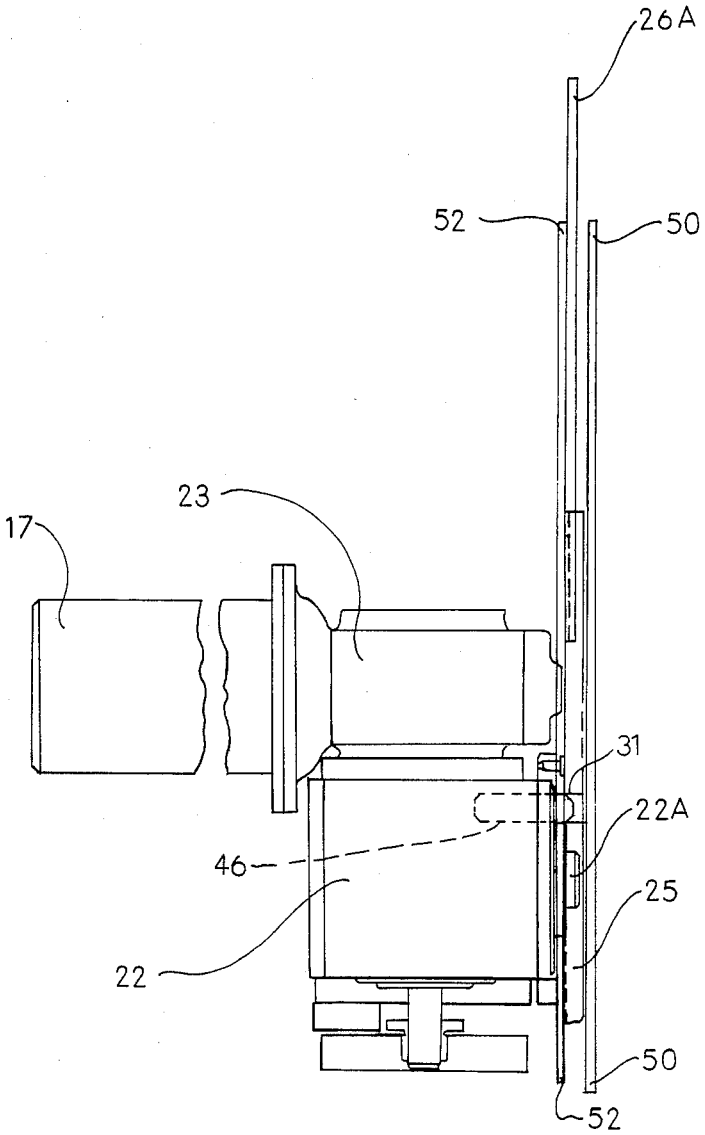
FIG. 5 is a front elevation of the ferris wheel arrangement and indexing mechanism.

FIGS. 1–5 illustrate a centerless grinding machine constructed in accordance with a preferred version of the invention. The grinding machine includes a machine bed 2 on which a movable axial slide 4 and cross-slide 6 are supported along with stationary worktable 8. A grinding wheel head 10 having spindle 12 and spindle-driven grinding wheel 14 are moved on the machine bed by the axial and cross slides. The worktable 8 supports a ferris wheel arrangement 20 and ferris wheel indexing means 22 to be described in more detail hereinafter.

As is typical in prior art constructions, the grinding wheel 14 is carried by the spindle 12 mounted in the grinding wheel head 10 for reciprocating motion into and out of grinding relation to the internal surface of the annular workpiece W, which, for example, may be a ball bearing raceway. The grinding wheel is also movable radially relative to the workpiece to engage the inner workpiece surface.

On the side of the ferris wheel arrangement 20 opposite the grinding wheel 14 is the workpiece driver 24 (FIG. 2) which may comprise a well known magnetic chuck/spindle mechanism, e.g., as described in U.S. Pat. No. 2,812,185 issued Nov. 5, 1957, or other well known workpiece drivers. Of course, the workpiece driver functions to rotate the workpiece W about its axis A (FIG. 4) at a relatively slow rotational speed compared to the high rotational speed of the grinding wheel 14 and spindle 12.

A ferris wheel arrangement 25 is provided in the form of a disc member having three, U-shaped pockets 30 spaced equally (120°) around its periphery or circumference with the pockets opening outwardly to receive a workpiece from the feed chute 26. Each U-shaped pocket 30 includes a workpiece alignment shoe 32 positioned normal to the right-hand leg of the U-shape when the pocket is in the load position (relative to FIG. 3).

The ferris wheel 25 is attached or coupled to the output shaft 22*a* of the rotary indexer 22 commercially available from Ferguson Machine Company. The rotary indexer has associated therewith a standard gear box 23 and electric motor 17 as is well known, the indexer being mounted on the worktable 8 of the grinding machine. The rotary indexer 22 functions to rotate the ferris wheel 25 and to index each U-shaped pocket 30 from the feed chute 26 where a workpiece is received to a grinding position where the pocket alignment shoe 32 is in the 6 o'clock position and stationary alignment shoe 44 mounted on shoe support 45 of the grinding machine is in the 3 o'clock position to align the outer surface or diameter of the workpiece for internal grinding (the inner diameter being ground concentric with the outer diameter by precisely supporting the latter by the shoes 32 and 44). At this position, the grinding wheel 14 is moved axially along the workpiece axis into the workpiece and then is displaced radially toward the 3 o'clock shoe to engage the inner workpiece surface while the outer surface is supported and aligned by the alignment shoes 32 and 44. During grinding, the workpiece is rotated in the pocket 30 against the shoes 32 and 44 by the magnetic driver 24 at a relatively slow speed while the grinding wheel 14 is rotated at a relatively high speed by spindle 12. During grinding, a longitudinally tapered locating pin 46 is actuated to enter an aperture 31 in the ferris wheel plate 25 to fix its position, FIGS. 4 and 5. The pin 46 is slidably mounted in standard bearings (not shown) in the frame of workpiece driver 24 and is slid into and out of engagement by a mechanical cam (not shown) mounted on the indexer shaft and to which the pin is connected. Of course, the pin 46 is withdrawn from the aperture 31 when grinding is finished to allow the ferris wheel plate 25 to be indexed.

After grinding, the grinding wheel 14 is withdrawn from inside the workpiece and the rotary indexer 22 is actuated to index the pocket 30 containing the ground workpiece from the grinding position to a discharge position where the pocket opens downwardly (relative to FIG. 3) toward the discharge chute 28 so that the workpiece falls by gravity into the chute.

As shown, the ferris wheel 25 is rotated between a front support plate 50 and a back support plate 52 separated by adjustable spacers 54 to a sufficient extent to allow the ferris wheel 25 to freely rotate therebetween while carrying workpieces in the pockets 30. The front plate 50 is held to the back plate 52 by the adjustable spacers and includes an aperture or opening 53 aligned coaxially with the workpiece and U-shaped pocket 30 when they are in the grinding position. Of course, the aperture 53 provides access for the grinding wheel 14 to the inner workpiece surface. The back support plate 52 includes a similarly aligned aperture (not shown) to provide magnetic driver access to the workpiece. The back support plate 52 is fastened as by bolts to the frame of indexer 22. The feed chute 26 and discharge chute 28 are supported on the back plate 52 such as by being bolted thereto.

The spacing between the front and back support plates 50 and 52 can be readily adjusted to accommodate different size workpieces (workpiece axial thickness) by the spacers 54. Similarly, workpieces of different diameter can be accommodated by providing a plurality of ferris wheels having different size U-shaped pockets with the ferris wheels being interchangeable on the grinding machine. Or, the pockets could be provided with replaceable inserts carried by the ferris wheel with different sets of inserts having different size pockets. Also, the feed chute 26 is provided with movable rails 26*a*, associated slots 26*b* and mounting bolts 26*c* so that the width of the chute can be adjusted to accommodate different diameter workpieces. The workpiece discharge path is adjustable by moving chute guide 27 along slots 27*b* to accommodate parts of different size. A guide rail 29 on guide support 29*a* is similarly adjustable along slots 29*c* to adjust the discharge path to accommodate parts of different size.

In operation, the ferris wheel 25 is rotated by indexer 22 to index the U-shaped pockets 30 thereof successively from the feed chute 26 where a workpiece is received in the respective pocket 30 and then to the grinding position where the stationary alignment shoe 44 and pocket alignment shoe 32 are at the 3 o'clock and 6 o'clock positions, respectively, relative to the workpiece outer diameter to align same. The grinding wheel 14 is moved axially into the workpiece by for example sliding the wheel head 10 and slide 4 axially and then is displaced by cross-slide 6 radially toward the 3 o'clock shoe to engage the inner workpiece surface. During grinding, the grinding wheel 14 is rotated at high speed and reciprocated axially to finish grind the inner workpiece surface while the outer workpiece surface is aligned by the shoes 32 and 44. To prevent slippage of the workpiece, it is rotated relatively slowly in the pocket 30 during grinding against the alignment shoes by the magnetic driver 24. When grinding is completed, the grinding wheel is withdrawn and the ferris wheel is indexed to position the pocket containing the ground workpiece to the discharge position where the workpiece falls by gravity into the discharge chute. The successive indexing of each pocket 30 to the loading, grinding and unloading positions provides a smooth, efficient work cycle for high production grinding while accuracy is maintained by the movable and stationary alignment shoes 32 and 44, respectively.

While there have been described what are considered to be certain preferred embodiments of the invention, other modifications, additions, and the like will occur to those skilled in the art and it is intended to cover in the appended claims all such modifications as fall within the spirit and scope of the invention.

We claim:

1. In a centerless grinding machine for grinding the inner surface of a cylindrical, tubular workpiece concentric with the outer surface, the combination of a rotatable ferris wheel means having multiple, circumferentially-spaced, workpiece-receiving pockets, a workpiece feed means at a first loading position adjacent the circumference of said ferris wheel means, a stationary workpiece alignment shoe means at a second grinding position adjacent the outer circumference of said ferris wheel means and a workpiece discharge means at a third unloading position adjacent the circumference of said ferris wheel means, indexer means for incrementally rotating said ferris wheel means to place each pocket thereof successively at the loading, grinding and unloading position, said ferris wheel means having workpiece alignment shoe means located in each of said pockets such that said stationary shoe means and the respective pocket shoe means support and align the outer workpiece surface when the respective pocket is at the grinding position and retain the workpiece substantially inside said respective pocket at the grinding position, a grinding wheel means on one side of said ferris wheel means movable axially inside the workpiece in said pocket in the grinding position and movable radially outward toward said stationary shoe means into engagement with the inner workpiece surface to grind said inner surface while said outer surface is aligned by said stationary shoe means and pocket shoe means, and a workpiece driver means on the other side of said ferris wheel means for rotating the workpiece in the pocket in the grinding position.

2. The grinding machine of claim 1 wherein there are three workpiece-receiving pockets on the ferris wheel means spaced 120° apart around its circumference.

3. The grinding machine of claim 1 wherein the stationary shoe means is disposed at about the 3 o'clock position and the pocket shoe means is disposed at about the 6 o'clock position when a respective pocket is placed in the grinding position.

4. The grinding machine of claim 1 wherein the ferris wheel means is positioned between a back plate member and front plate member, said feed means and discharge means being supported on said back plate member, said front plate member having an opening coaxial with a respective pocket in the grinding position to provide access for entry of said grinding wheel means into the workpiece.

5. The grinding machine of claim 4 wherein the feed means comprises a feed chute and wherein the discharge means comprises a discharge chute.

6. The grinding machine of claim 1 wherein the ferris wheel means is located in the grinding position by a locating means engaging therewith at said position.

7. The grinding machine of claim 6 wherein the locating means is a tapered pin adapted to engage an aperture in the ferris wheel means.

* * * * *